United States Patent [19]

Kreitz

[11] 3,982,411

[45] Sept. 28, 1976

[54] WET TREATMENT DEVICE FOR DYEING TEXTILE MATERIAL IN THE FORM OF AN ENDLESS ROPE

[75] Inventor: Hans Kreitz, Stolberg, Rhineland, Germany

[73] Assignee: Firma H. Krantz, Aachen, Germany

[22] Filed: May 30, 1975

[21] Appl. No.: 582,202

[30] Foreign Application Priority Data

June 26, 1974 Germany ..... 7421693

[52] U.S. Cl. ..... 68/177

[51] Int. Cl.[2] ..... D06B 3/24; D06B 3/28

[58] Field of Search ..... 68/177, 178, 184

[56] References Cited

UNITED STATES PATENTS

| | | | |
|---|---|---|---|
| 3,599,447 | 8/1971 | Arashi | 68/177 |
| 3,659,438 | 5/1972 | Chiba et al. | 68/177 |
| 3,679,357 | 7/1972 | Christ et al. | 68/177 X |
| 3,782,138 | 1/1974 | Kawasaki et al. | 68/177 |

*Primary Examiner*—Philip R. Coe
*Attorney, Agent, or Firm*—Arthur B. Colvin

[57] ABSTRACT

A wet treatment device for dyeing textile materials in the form of an endless rope comprising a pressure tank consisting of a horizontal storage portion having one end curved upwardly with a vertical deflection portion rising from such curved end, a driving tube being provided having the mouth end thereof leading into the deflection portion and its other end leading into the other end of said horizontal portion. The rope is advanced continuously, at first in stretched form, through the driving tube by means of jets of treatment liquid, into the other end of the horizontal storage portion in which it floats in loops through the treatment fluid therein in the direction of the deflection portion where it rides over a rotating wheel which guides the rope in stretched form into the mouth of the driving tube.

5 Claims, 3 Drawing Figures

WET TREATMENT DEVICE FOR DYEING TEXTILE MATERIAL IN THE FORM OF AN ENDLESS ROPE

As conducive to an understanding of the invention it is noted that wet treatment devices are designed, depending upon the textile material to be treated, either as nozzle dyeing devices where the feed of the rope is effected by ring nozzles through which the treatment liquid is forced and directed against the rope, or the so-called soft dyeing devices in which the feed of the rope is effected substantially by the flow gradient of the treatment liquid.

The nozzle dyeing device can only be used for insensitive textile material, since the liquid charged ring nozzles must exert a great force on the rope to insure its circulation, which leads to rigid folds which are not eliminated by the passage of the rope through the nozzles.

The soft dyeing device has therefore been provided for delicate textile material where the rope is held in circulation in the loosened state by a relatively slow flow of the liquid.

It is accordingly among the objects of the invention to provide a wet treatment device in which any type of textile material can be subjected to a wet treatment, particularly dyeing, corresponding to its sensitivity.

The wet treatment device is provided with means to facilitate replacement of the ring nozzles in the driving tube of the device, so that as a result of the changeability of the ring nozzles the wet treatment device can be used with correspondingly different design ring nozzles for both sensitive and insensitive textile material.

Thus, the wet treatment device according to the invention can be operated with a corresponding set of nozzles as a pure nozzle dyeing device where the rope, after passing over a wheel or cylinder in the deflection portion of the device, is conducted directly into a driving tube. In the case of delicate textile materials, however, the rope is conducted over the wheel or cylinder into the driving tube in which correspondingly designed ring nozzles for a soft wet treatment are arranged. By providing an access port in the vertical deflection portion, a simple and rapid replacement of the ring nozzles may be effected depending upon the type of material to be treated.

It is also within the scope of the invention to provide the driving tube with a curved inlet or mouth which may be rotated 180° and to by-pass the wheel or cylinder and feed the rope directly into the curved inlet of the driving tube.

The wet treatment device according to the invention can be filled partly or completely with liquid, depending upon its use as a nozzle dyeing device or as a soft dyeing device.

In order to enhance the circulation of the rope, according to an embodiment of the invention, the curved inlet or mouth of the driving tube has perforations in the convex wall thereof which is on its outside radius. With a corresponding high liquid level in the deflection portion, as a result of the perforations, the liquid charged ring nozzles in the driving tube permit an additional amount of liquid to be sucked through the perforations for feeding the rope.

According to another feature of the invention, the cross section of the driving tube is reduced continuously over a part of the length in the direction of flow of the liquid. This causes an acceleration of the liquid flow, providing an evenly distributed traction on the rope particularly over the length of the driving tube and which is fully maintained to the end of the driving tube.

According to still another feature of the invention, the end of the driving tube leads into a frusto-conical funnel in the storage portion which widens in the direction of flow of the liquid. This ensures that the revolving speed of the rope is reduced at this point so that the rope is deposited in loops as soon as it enters the storage portion.

In order to enhance the loop formation, a cylindrical perforated shell is connected to the frusto-conical funnel, the perforated shell forming over its length an inner torus with the shell of the storage portion. From this torus can be sucked off an additional amount of the liquid, so that not only are the driving forces on the rope increased, but the dwell period of the rope in the storage portion can be increased as required.

According to another embodiment of the invention, an insert in the form of an inclined frustum is provided, tapered in the direction of motion of the rope and which extends into the deflection portion at the top of the upwardly curved end of the storage portion so that the rope rising therefrom vertically to the wheel or cylinder issues axially from the upwardly curved end. This design also ensures that the loops in the rope rising to the wheel or cylinder are eliminated so that the rope is in stretched form when it enters the driving tube.

For the nozzle dyeing form of operation of the wet treatment device a ring nozzle directed against the direction of motion of the rope is provided in the frustum-shaped insert, the latter having perforations in the side thereof. This design ensures that the rope, when by-passing the wheel or cylinder, does not dam up in front of the ring nozzles acting as driving nozzles, since the ring nozzles directed against the direction of motion of the rope have a regulating braking effect on the rope so that the latter is fed in a sufficiently stretched form to the ring nozzles.

In the accompanying drawings in which are shown one or more of various possible embodiments of the several features of the invention:

Figure 1:
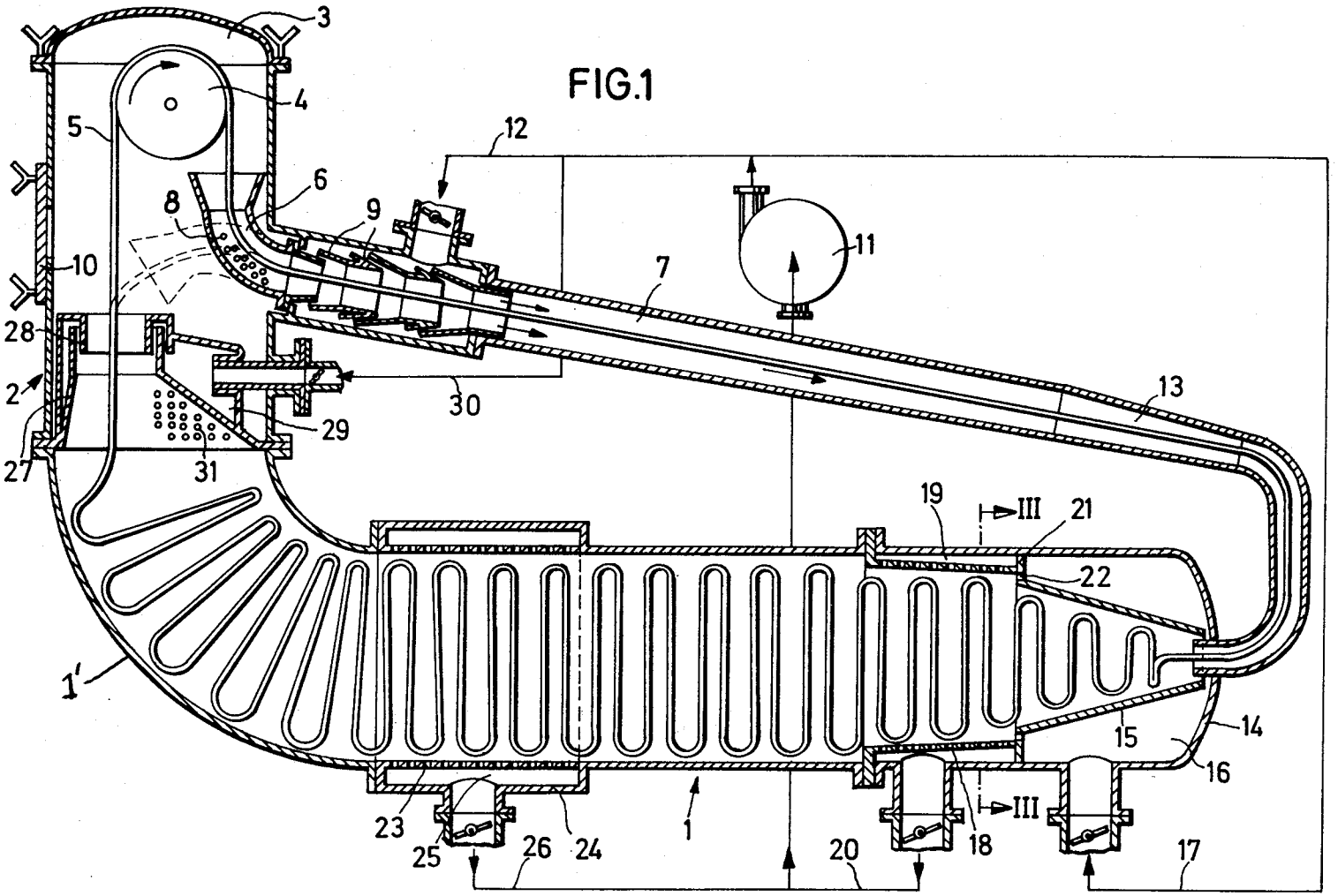
FIG. 1 shows the device in a vertical longitudinal section.

Referring now to the drawings, the wet treatment device comprises substantially a pressure tank having a horizontal cylindrical storage portion 1, as well as a vertical cylindrical deflection portion 2, the lower end of which is connected to the upwardly curved end 1' of storage portion 1.

The deflection portion 2 terminates at the top thereof in a dome 3 in which is positioned a wheel or cylinder 4 which rotates freely, but which can also be driven, if necessary.

A textile rope 5 riding over cylinder 4 in the direction of the arrow is conducted into the upwardly curved portion 6 or the mouth of a driving tube 7. Curved portion 6 has in the range of its convex or outer surface, perforations 8 through which a part of the treatment liquid is sucked in, in the direction of feed of the textile rope 5, due to the suction effect of ring nozzles 9 in the upper portion of driving tube 7.

On the side of deflection portion 2 opposite curved portion 6 is a closable opening 10 through which the curved portion 6 and the ring nozzles 9 can be adjusted and disassembled and replaced by differently designed elements.

The ring nozzles 9 are charged with liquid through a pump 11, a line 12, in addition to other lines, extending from its pressure side to the ring nozzles 9. Driving tube 7 is continuously reduced in its cross section over a portion 13 thereof in the direction of the flow of the liquid, before it penetrates, after curving twice, through one end wall 14 of storage portion 1. In storage portion 1, the driving tube 7 opens into a frusto-conical funnel 15 widening in the direction of flow, so that the velocity of flow of the liquid diminishes and the rope 5 passes from the stretched form into loops and/or spirals.

A conical torus 16 is defined between the frusto-conical shell 15 and the adjacent wall of storage portion 1 and is in communication with another pressure line 17 from pump 11.

Figure 3:
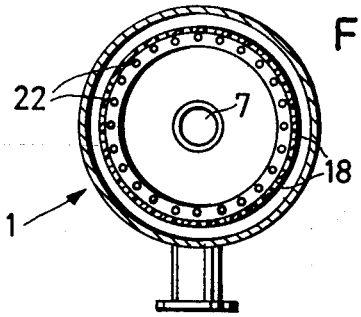
FIG. 3 shows a section through the storage part along the line III—III of FIG. 1.

The frusto-conical shell 15 leads into a cylindrical perforated shell 18 which forms with the adjacent wall of storage portion 1, a torus 19 from which treatment liquid is sucked off by a suction line 20 of pump 11, so that the loops and/or spirals are compressed in the respective storage portion 1. The front flange 21 of cylindrical shell 18 is provided with bores 22, as can be seen particularly in FIG. 3, so that the liquid has a flow component from the conical torus 16 which is substantially coaxial with storage portion 1 and thus enhances the feed of the rope 5.

The wall of storage portion 1 adjacent its upwardly curved end 1' has perforations 23 over which an outer torus 25 is formed by an enlarged diameter cylindrical sheath 24, which is connected by a line 26 to the suction side of pump 11. The liquid sucked from storage portion 1 by this arrangement enhances the feed of the rope 5 from the end 14 of storage portion 1 in the direction of the deflection portion 2.

At the upper end of the upwardly curved end 1' is arranged an insert 27, tapered in the direction of motion of the rope 5 and which has the form of an inclined frustum and which protrudes into deflection portion 2 so that rope 5 rises axially therefrom and extends vertically to the cylinder 4.

The upper end of the frustum-shaped insert 25 is designed as a ring nozzle 28 directed against the direction of motion of the rope 5 and is connected to an asymmetrical torus 29 which is charged with liquid through line 30, also connected to the pressure side of pump 11. The insert 27 has perforations 31 through which a part of the circulating liquid flows also against the direction of motion of the rope 5, so that rope 5 can be fed in stretched form to cylinder 4, depending on the type of textile material, even without charging ring nozzles 28 with liquid.

Figure 2:
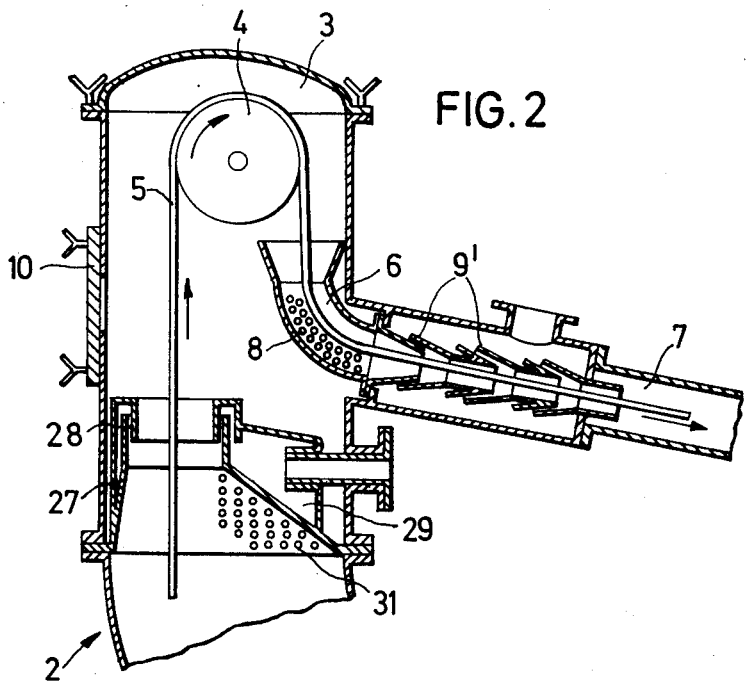
FIG. 2 shows in the same section the deflection portion of the device according to FIG. 1 but with constricted ring nozzles.

If the wet treatment device is to be operated as a pure nozzle dyeing device, the relatively narrow ring nozzles 9' represented in FIG. 2 will be used and the pressure of pump 11 will be so increased that the circulation of the rope is ensured by the treatment device. The curved portion 6 can be turned by 180 degrees (see dotted line position), as an alternative to use of the cylinder 4, so that rope 5 is pulled into driving tube 7 and by-passes the cylinder 4.

If the wet treatment device is to be used as a soft dyeing device, it is advisable to use the ring nozzles 9 shown in FIG. 1 which can be so charged with liquid by reducing the pressure of pump 11 that a sensitive rope may be conducted in a cycle floating through the entire device. In such case, cylinder 4 is driven positively.

Having thus described my invention, what I claim as new and desire to secure by Letters Patent of the United States is:

1. A wet treatment device for dyeing textile materials in the form of a curved rope comprising a pressure tank having a horizontal storage portion including first and second ends, an upwardly curved portion at said first end, a vertical deflection portion rising from said upwardly curved portion, a driving tube having one end leading into said deflection portion and another end, said other end of said tube leading into said second end of said storage portion, said one end of said driving tube having a curved mouth portion, means for shifting said curved mouth portion through an angle of 180° between first and second positions, respectively, in which said curved portion faces directly upwardly and in which said curved portion faces directly downwardly, said rope extending through said storage portion, said deflection portion, and into said curved mouth portion of said driving tube, means to charge said storage portion with treatment liquid, a plurality of ring nozzles in said driving tube adjacent said curved mouth portion, means to charge said nozzles with treatment liquid under pressure for feeding said rope in stretched condition through said driving tube to form loops in said storage portion and advance said rope through the treatment liquid in said storage portion into said deflection portion, and means providing access to said ring nozzles for replacement thereof.

2. A wet treatment device for dyeing textile materials in the form of a curved rope comprising a pressure tank having a horizontal storage portion including first and second ends, an upwardly curved portion at said first end and a vertical deflection portion rising from said upwardly curved portion, a driving tube having a first end leading into the deflection portion and a second end leading into said second end of said storage portion, said first end of said driving tube having a curved mouth portion, said rope extending through said storage portion, said deflection portion, and into said curved mouth portion of said driving tube, means to charge said storage portion with treatment liquid, a plurality of ring nozzles removably mounted in said driving tube adjacent said curved mouth portion, said ring nozzles each including an annular discharge orifice surrounding the axis of said driving tube, means for charging said nozzles with treatment fluid under pressure and for discharging said fluid through said orifices in the direction of movement of said rope through said tube whereby said rope is centered within said ring nozzles by the fluid emerging from said orifices and fed in stretched condition through said driving tube to form loops in said storage portion and advance said rope through the treatment liquid in said storage portion and into said deflection portion, and access hatch means adjacent said one end of said driving tube for providing access to said ring nozzles for replacement thereof.

3. The device set forth in claim 1 further including a frusto-conical funnel positioned in said other end of said storage portion and forming a conical torus with respect to the adjacent wall surface of said storage portion, said other end of said driving tube leading into the smaller diameter end of the funnel, said funnel being widened in the direction of flow of the liquid, a cylindrical perforated shell positioned in said storage portion, said shell having one end connected to the wider diameter end of said funnel, said cylindrical perforated shell forming a cylindrical torus with respect to the adjacent wall surface of said storage portion, a flange defined at the connection between the funnel and the cylindrical perforated shell, said flange having perforations therethrough providing communication between said cylindrical torus and said conical torus, said storage portion adjacent the curved portion thereof having perforations in the wall thereof, a cylindrical sheath of larger diameter than said perforated wall portion encompassing the latter to define an outer cylindrical torus and means to provide treatment liquid under pressure to said conical torus and suck treatment liquid from said cylindrical torus and said outer cylindrical torus.

4. The device set forth in claim 3 further including a funnel positioned at the upper end of the curved portion of the storage portion with the smaller diameter portion of the funnel extending into said deflection portion, said funnel being in the form of an inclined frustum, the rope extending substantially axially through the mouth of said funnel, a ring nozzle associated with the mouth of said funnel and designed to expel liquid toward the wider diameter portion of said funnel in direction opposed to the direction of movement of the rope through the mouth of said funnel, a closed cavity encompassing said funnel, and means to force treatment liquid under pressure into said closed cavity for flow of such liquid through the ring nozzle.

5. The device set forth in claim 4 wherein said funnel has an inclined elongated wall and said funnel has perforations in the side wall thereof adjacent said elongated wall.

* * * * *